United States Patent [19]

Lemire

[11] Patent Number: 4,953,857

[45] Date of Patent: Sep. 4, 1990

[54] ORTHOPEDIC BACK SUPPORT ATTACHMENT FOR A WEIGHT LIFTER'S BENCH

[76] Inventor: Brett J. Lemire, 5605 Laguna Dr., Sacramento, Calif. 95758

[21] Appl. No.: 385,380

[22] Filed: Jul. 27, 1989

[51] Int. Cl.[5] ..... A63B 21/072

[52] U.S. Cl. ..... 272/123; 272/144; 5/411

[58] Field of Search ..... 272/123, 134, 144, DIG. 4; 128/68, 69; 5/402, 411; 297/218

[56] References Cited

U.S. PATENT DOCUMENTS

| | | | |
|---|---|---|---|
| 885,243 | 4/1908 | Haas . | |
| 1,904,039 | 4/1933 | Bruder . | |
| 2,048,587 | 7/1936 | Averill . | |
| 2,264,046 | 11/1941 | McClellan . | |
| 3,117,782 | 1/1964 | Johnston . | |
| 3,120,407 | 2/1964 | Prorst | 297/218 X |
| 4,230,099 | 10/1980 | Richardson | 128/69 |
| 4,407,495 | 10/1983 | Wilson | 272/134 X |
| 4,474,370 | 10/1984 | Oman . | |
| 4,492,375 | 1/1985 | Connelly | 272/144 X |
| 4,530,123 | 7/1985 | Mathou | 5/411 X |
| 4,609,188 | 9/1986 | Lind | 272/144 X |
| 4,621,809 | 11/1986 | Pearl . | |
| 4,710,991 | 12/1987 | Wilmore et al. | 272/144 X |

*Primary Examiner*—Robert W. Bahr

[57] ABSTRACT

A padded cervical spine rest and a padded lumbar spine rest in combination with a padded mat each having a centrally aligned spine protecting channel. The spine protecting channel supports the back yet eliminates the compression of the spinal column normally associated with weight lifting. The mat and the two padded rests are removably attachable to a conventional weight lifter's bench in combination or as single units. Each of the padded rests are contoured to be compatible in shape with the specific area of the human anatomy to be supported. The padded cervical spine rest has crescent shaped edges which allows user shoulder and arm movement without rubbing against the edge of the pad.

5 Claims, 7 Drawing Sheets

ORTHOPEDIC BACK SUPPORT ATTACHMENT FOR A WEIGHT LIFTER'S BENCH

BACKGROUND OF THE INVENTION

1. Field of the Invention

This invention relates to orthopedic back supports useful on weight lifter's benches to prevent compression and abnormal curvatures of the spine during weight lifting. The present invention is particularly directed towards attachable padding shaped to provide support and increased safety to the cervical and lumbar spine areas of the weight lifter during weight lifting exercise.

2. Description of the Prior Art

Subjecting the human body to any program of weight lifting over a given period of time will eventually result in a compensatory loss of normal physiologic curves in the cervical and lumbar spines. As curves in the human spine function like a coil or spring to decrease and distribute forces through the spine, curve loss decreases the spines ability to control forces conveyed in every day activity. Early recognition of the need to prevent a reduction of spine curvature loss when the human body is reclined and under physical stress is seen in U.S. Pat. No. 885,243, issued Apr. 21, 1908, to G. W. Haas. Although the Haas invention is not particularly directed towards weight lifting or exercising, his device does illustrate a variety of pads useful to support the prone human body. An exercising support pad contoured to the shape of the human body back curves is shown in U.S. Pat. No. 1,904,039, dated Apr. 18, 1933, granted to Bruder. U.S. Pat. No. 2,048,587, Jul. 21, 1936, shows a cervical support and U.S. Pat. No. 2,264,046, Nov. 25, 1941, disclose a rather severe lumbar supporting exercising device. The supports shown in the foregoing devices shown recognition that a need for a practical padding to protect the human back during weight lifting exercising is needed. Further recognition of the back support need is seen in the pillow-like padding of U.S. Pat. No. 3,117,782, in the adjustable rounded pads illustrated in U.S. Pat. No. 4,474,370, and the forming padding in the bench shown in U. S. Pat. No. 4,621,809.

Only on the bench in U.S. Pat. No. 4,474,370, dated Oct. 2, 1984, issued to Oman, is shown consideration for both cervical and lumbar areas support of the spine during weight lifting exercising. Oman shows the pad for lumbar support position adjustable but makes no provision for body size differences in the cervical spine area.

None of the past art devices make provisions to eliminate pressure exerted on the full length of the spine during various sequences of weight lifting procedures.

In the orthopedic back support attachment for a weight lifter's bench as disclosed in this specification, I provide fully adjustable supports which reduce the danger of the individual weight lifter losing back curvature during weight lifting from an reclined position, and more importantly I provide means to relieve the pressure exerted directly on the full length of the spine.

SUMMARY OF THE INVENTION

To accomplish back curvature protection and insure comfortable back support for the individual lifting weights from a reclined position, the immediate invention provides padded rests attachable to a conventional weight lifter's bench. In structuring the rests, consideration has been taken into account for providing each rest with contouring compatible with the shape of the area of the human anatomy to be supported. Also, as a viable part of the immediate invention, the device includes a padded bench covering or mat which is centrally channeled longitudinally to provide an opening the full length of the mat for arresting the spine area. This longitudinally opened area relieves the pressure normally placed on the spine when the human body is reclined on a flat surface such as the top of a weight lifter's bench. The mat is sized to fit a conventional weight lifter's bench, is provided with stretch material in fitted skirting to accommodate variations in width and length of different benches, and has adjustable belting to hold the mat secure to the bench. On a longitudinal portion of the mat skirt which extends under the bench along each side, a strip of hook and loop fastening material is affixed. The hook and loop strips are for positional attachment of the belt ends of cervical and lumbar support pads which are removably fitted to the top pad-side surface of the mat.

Two particularly shaped pads, one for cervical spine area support and one of lumbar spine area support, are removably attachable to the pad side surface of the mat. The lumbar spine area support pad is shaped half rounded and gradually curved from widened wing-like outer ends to a small narrowed center section. The lumbar spine area support pad is structured to saddle shape from the user's weight and to particularly contour to the shape of the human lumbar area so the spine and lower back torso rests saddled in a comfortable fitted support. The cervical spine area support is also a half-rounded pad having wide outer ends curving to a smaller center area similar to the lumbar spine area support pad. The center area of the cervical spine area support remains sufficiently thickened to fit under the back neck area of the human user and provide a cushioned but firm padding for the cervical spine area. The cervical spine area support pad is cut to form a half elliptical curve along the edges adjacent the user's shoulders. The cut gives the cervical spine area support in a half moon shape near the user's shoulders. This half-moon curvature allows the person exercising with weight to move his arms freely without the edges of the cervical spine area support pad rubbing on his shoulders or restricting upward movement of his or her arms. Both the cervical spine area support pad and the lumbar spine area support pad can be attached in a desired position on the top side of the bench secured by hook and loop attach ends which can be tightened to each other under the bench. Although, the two support pads are designed to be used with the padded mat, the attach arrangements allows the use of the padded mat with or without either support pad.

The strips of hook and loop material along the longer edges of the mat skirt under the bench do, however, allow additional securing of the support pads and also provide a second method for fastening the support pad straps under the bench without attaching them to each other. Both the lumbar spine area pad and the cervical spine area pad have a centrally aligned transverse indentation for arresting the human spine. The pad spine arresting indentations are useful both cooperatively with the mat spine arresting groove according to the immediate invention and when the pads are used on a weight lifter's bench without the mat.

Therefore, it is a primary object of the invention to provide spinal curve arresting and protective padding in positionable units adjustably attachable to a weight lifter's bench.

Another object of the invention is to provide in part with other attachments, a padded mat sized to fit a weight lifter's bench and providing a spinal protecting channel flanked by padded edges which keep a user's body resting with the spinal cord elevated and not pressed against the flat surface of the weight lifter's bench.

A further object of my invention is to provide a cervical spine support pad and a lumbar spine support pad with both pads being positional and removably attachable to a weight lifter's bench.

A still further object of the immediate invention is to provide a padded mat with a spinal protecting channel and two spinal curvature protective pads having spinal protecting channels which are attachable to a weight lifter's bench all together as a single interactive device or attached and used as separate functional units.

Other objects and the many advantages of this invention will become clear and understood by reading descriptions of the numbered parts in the remaining specifications and comparing them with like numbered parts illustrated in the accompanying drawings, a part herewith.

DESCRIPTION OF THE PREFERRED EMBODIMENTS

Figure 4:
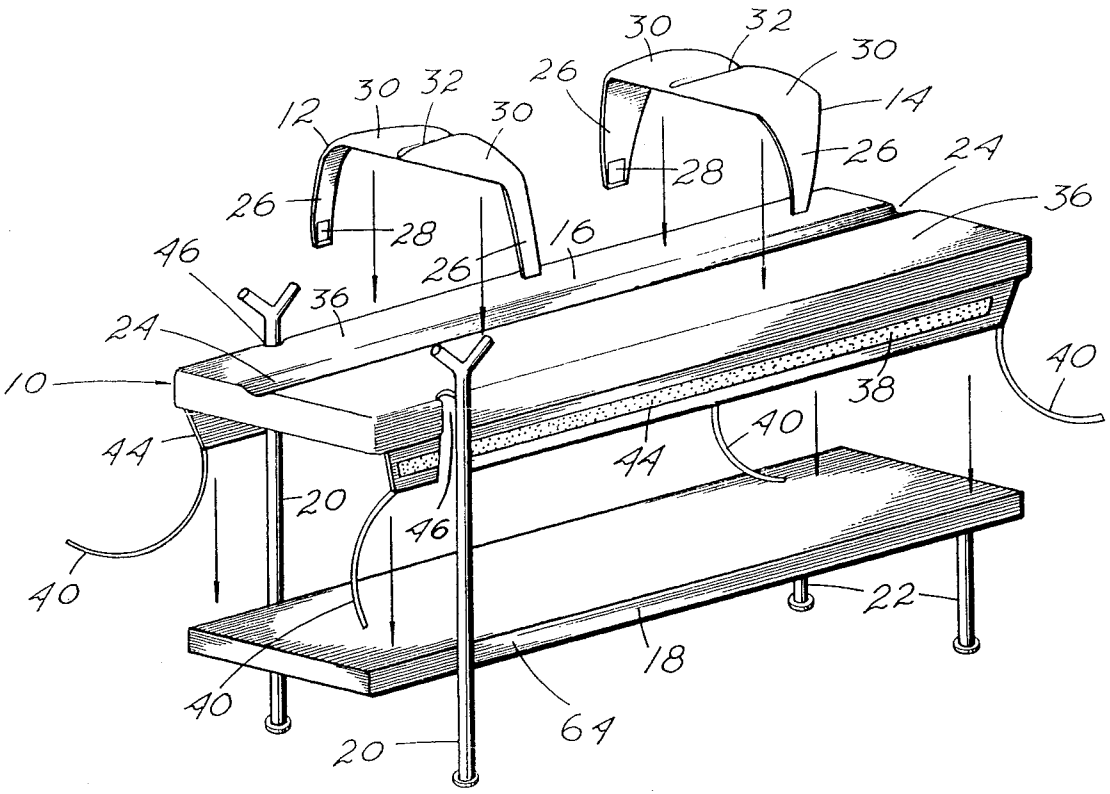
FIG. 4 is an exploded view of the invention showing the cervical spine area pad and the lumbar spine area pad positioned above the padded mat which in turn is positioned above a conventional weight lifter's bench in the order of attachment.
Figure 5:
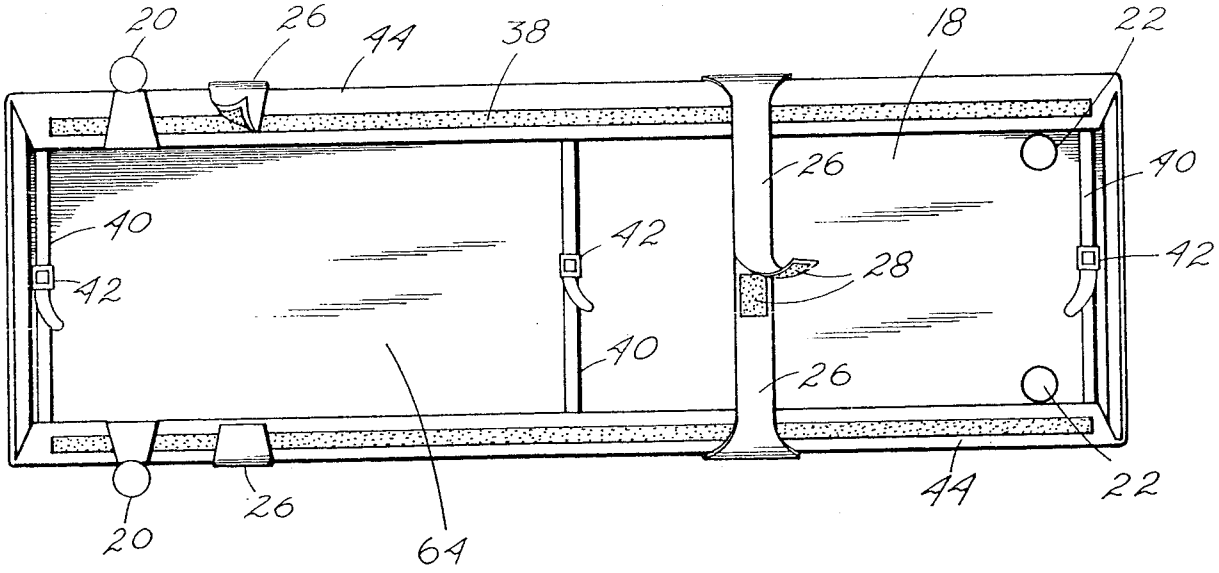
FIG. 5 is a view of the weight lifter's bench from the bottom, showing the mat skirt attached by belts and buckles and the ends of short tabs holding the cervical spine area pad left in the illustration fastened by hook and loop fasteners along the bottom edges of the mat skirt. On the right in the illustration, the attachment ends of the lumbar spine area pad is shown fastened to each other by hook and loop fasteners.
Figure 7:
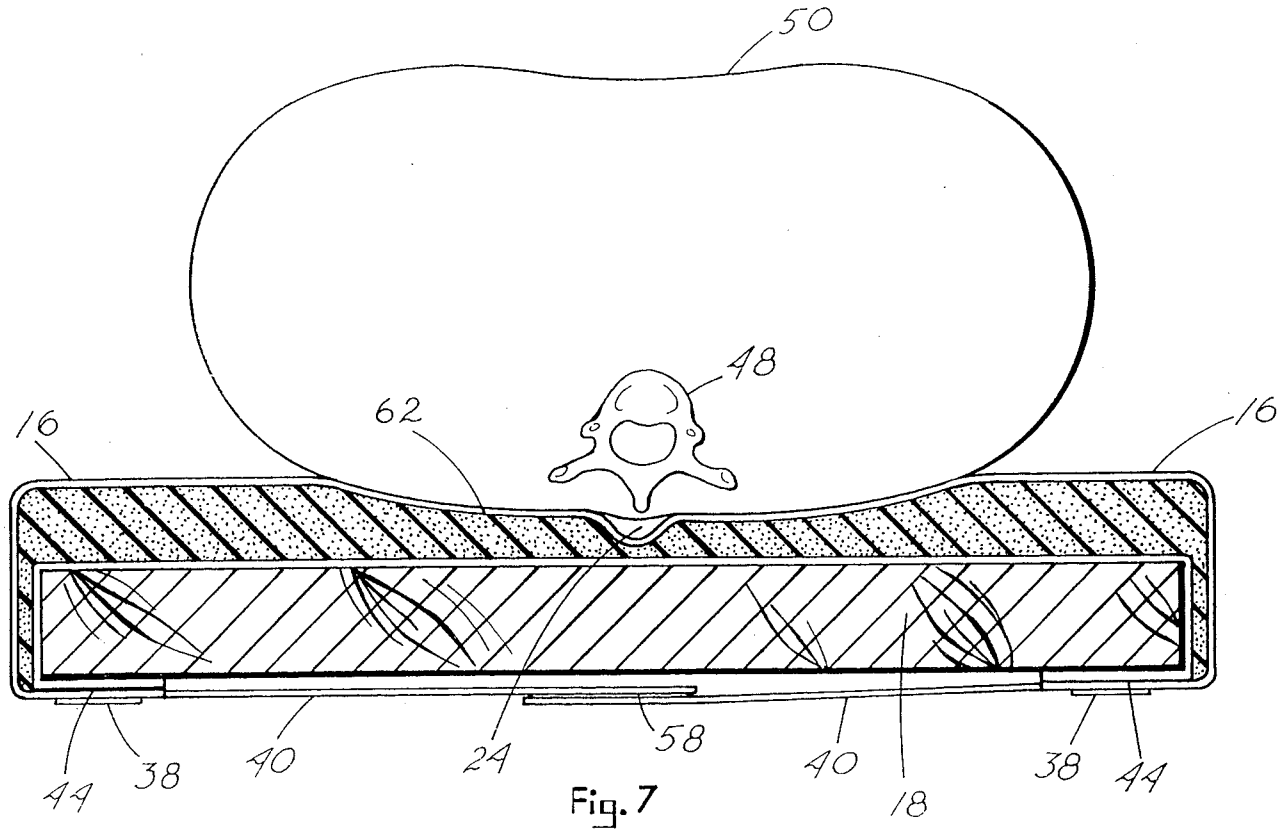
FIG. 7 is the end view of FIG. 6 sectioned through the user's thoracic cavity showing the human spinal column relative to the spinal arresting channel in the center of the padded mat. The padded mat is retained to the weight lifter's bench board by belt members fitting around the board and attached together by hook and loop fasteners.

Referring now to the drawings beginning with the separated parts of the invention illustrated in FIG. 4. The numeral 10 generally indicates all invention members and a typical weight lifter's bench is indicated as conventional weight lifter's bench 64. The FIG. 4 illustration shows invention members 10 with cervical spine area pad 12 and lumbar spine area pad 14 positioned above padded mat 16 ready for installation on weight lifter's bench board 18. Weight lifter's bench board 18 is supported at the rear by back legs 22 underneath and at the front by front legs and barbell supports 20 which extend up along the sides of weight lifter's bench board 18. This is normal structure for most conventional weight lifter's benches 64. To fit padded mat 16, mat fit openings 46 are cut in the head sides of padded mat 16. Mat fit openings 46 have no skirting 44 below the cut which allows padded mat 16 to fit easily down flush on the upper surface of weight lifter's bench board 18 adjacent front legs and barbell supports 20. With padded mat 16 resting on the upper surface of weight lifter's bench board 18, mat skirting 44 is pulled underneath to expose hook and loop strip 38 faced downwards along the edges. Padded mat 16 is then retained by belt attachments 40 which can be tied or have buckles 42, as illustrated as a method of securing the ends together. Belt attachments 40 can also be fastened together by hook and loop belt fasteners 58, see FIG. 7. With padded mat 16 in place, cervical spine area pad 12 and lumbar spine area pad 14 are positioned for best use transversely relative to weight lifter's bench board 18. Cervical spine area pad 12 and lumbar spine area pad 14 are attached by pad attachment tab members 26. Pad attachment tab members 26 are affixed along facing sides with hook and loop fasteners 28. The ends of pad attachment tab members 26 can be tightened and fastened to each other under weight lifter's bench board 18 or attached to hook and loop strip 38 on mat skirt 44 on the under side of weight lifter's bench board 18. See FIG. 5. As it is immaterial whether the hook or the loop section of hook and loop fasteners are attached to a particular part, herein after where this type of fastening is used, the attachment method will simply be designed hook and loop fasteners 28 or hook and loop strips 38.

Figure 6:
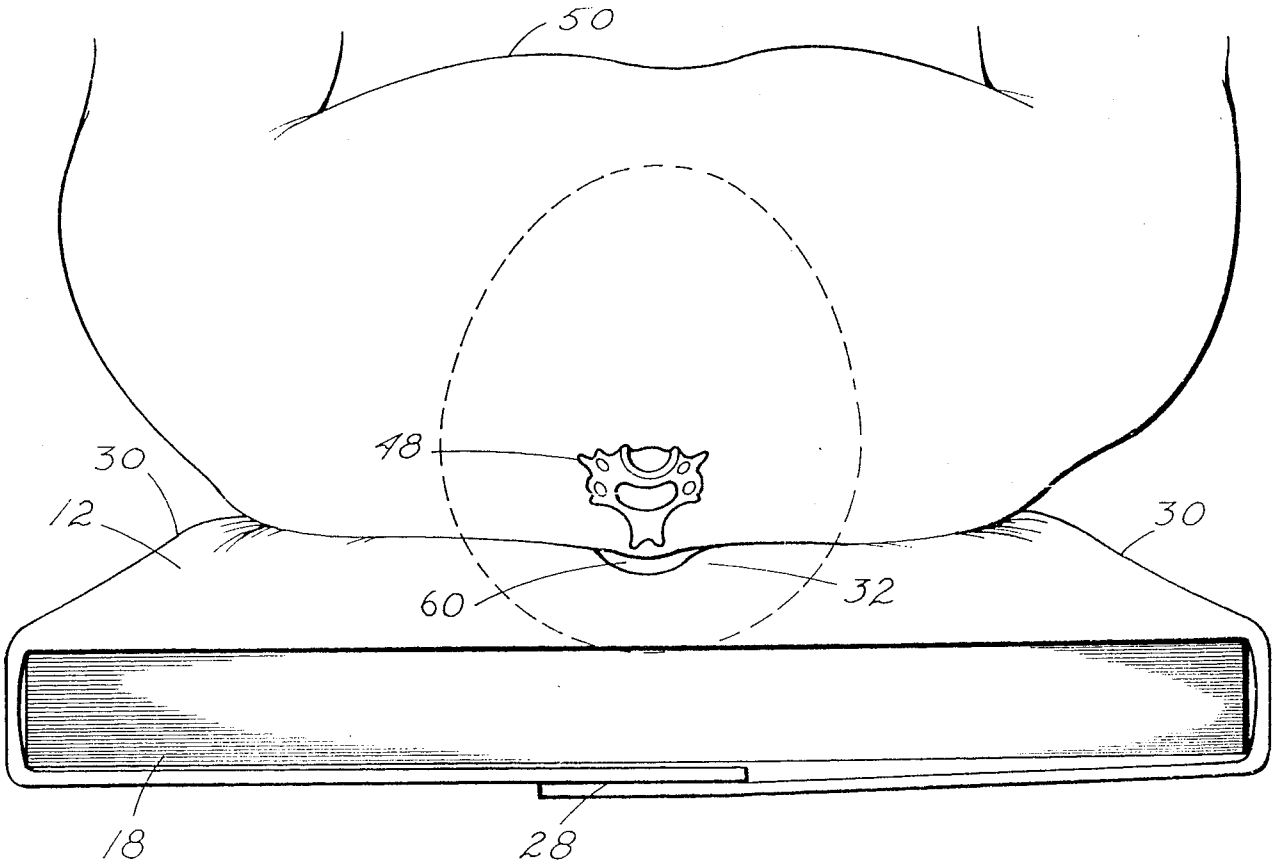
FIG. 6 is a view from the head end of a weight lifter's bench showing the end of a human spine column pictorially in the cervical area through dotted lines indicating a human user's head. The maintained curve of the cervical area spine is illustrated relative to the rounded and reduced size center area in the cervical spine area pad. The cervical area pad is shown supporting the human neck with the pad retained by extended pad tab attachment members passed under the bench board and attached together by hook and loop fasteners.

Important to weight lifter 50 and considered unique to the immediate invention is spinal arresting channel 24. Spinal arresting channel 24 is a longitudinal groove centrally aligned in padded mat 16, best illustrated in FIG. 4 in a perspective view of padded mat 16 and a head end view in FIG. 6. Padded along the sides by mat padding 36, spinal arresting channel 24 provides support along both sides of human spinal columnn 48 while alleviating direct pressure on spinal column 48.

Figure 1:
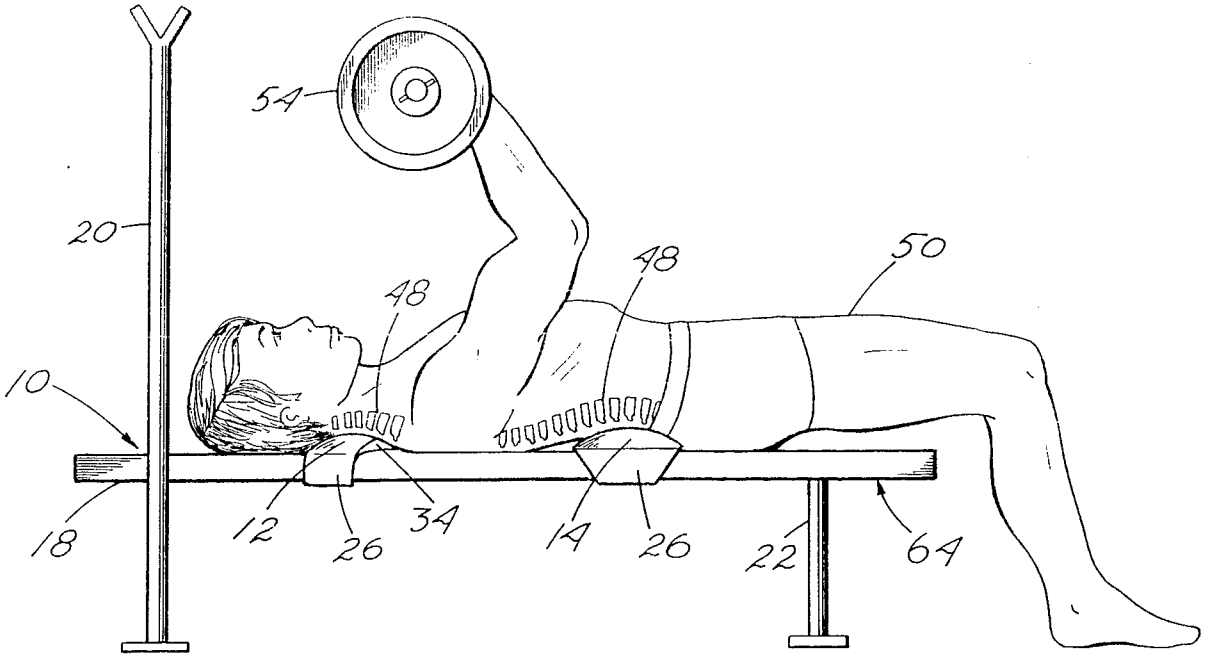
FIG. 1 shows the cervical spine area pad and the lumbar spine area pad according to the invention attached to a weight lifter's bench and in use. The spinal column of the weight lifter's body is illustratively diagramed in the pad support areas.
Figure 2:
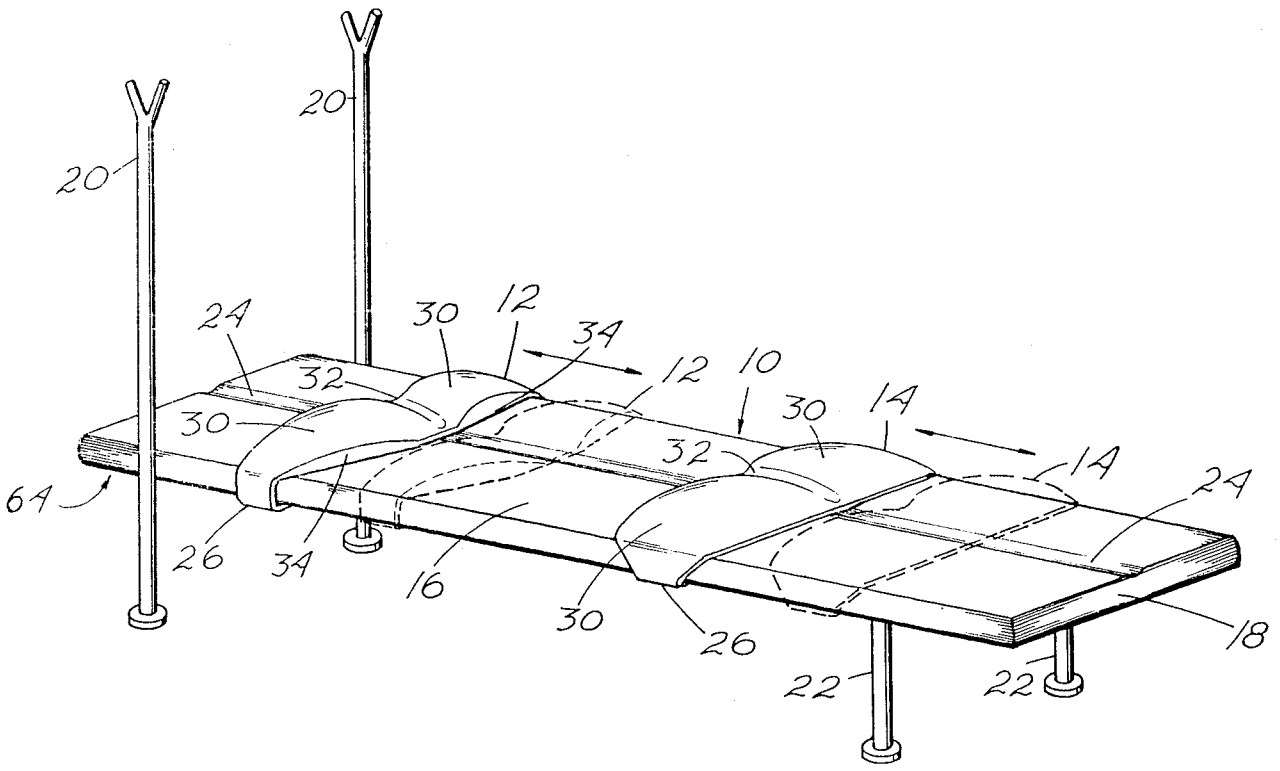
FIG. 2 is a perspective view of a conventional weight lifter's bench with the padded mat according to the invention attached and the two support pads affixed to the upper surface of the mat. The spinal protective channel centrally aligned longitudinally in the padded mat structure can be seen and the adjustability of the cervical support pad and the lumbar support pad is illustrated by dotted lines.

The shaping of cervical spine area pad 12 and lumbar spine area pad 14 is best seen in FIG. 2. Both pad 12 and pad 14 are shaped with ballooning wing areas, pad wings 30, and have a grooved central transverse recess, pad reduced size center 32 and pad spinal arresting groove 60. Pad spinal arresting groove 60 is similar to and cooperative with spinal arresting channel 24 in padded mat 16. Ballooning pad wings 30 curve downwards centrally to pad reduced size center 32. Pad wings 30 on lumbar spine area pad 14 are widened some centrally but balloon more outwardly relative to pad reduced size center 32 while cervical spine area pad 12 has pad wings 30 widened more towards the center. Particular to functional use of cervical spine area pad 12 are the crescent shaped notches, cervical pad shoulder notches 34, which are formed into the edges of both pad wings 30 of cervical spine area pad 12 on the edge which will be adjacent the shoulders of weight lifter 50. Experimentation has disclosed that when weight lifter 50 lifts weights 54 as illustrated in FIG. 1, his shoulders tend to rub the straight edges of any neck support pads. To prevent either frictional irritation to the user's shoulders or discomfort, the cervical spine area pad of the immediate invention has shoulder clearance in the form of crescent shaped cervical pad shoulder notches 34 formed along the shoulder side edge of both pad wings 30. See FIG. 1, FIG. 2, and FIG. 3. The ballooning of lumbar spine area pad 14 enlarges vertically outwardly from pad reduced size center 32 forming saddle shape 62 which is fundamental to provide positional maintenance for weight lifter 50 as well as curvature support for human spinal column 48, see FIG. 1. Saddle shape 62 forms as the weight of weight lifter 50 is imposed centrally on lumbar spine area pad 14 and the ballooning sections of pad wings 30 compensate for the body weight of weight lifter 50.

Figure 3:
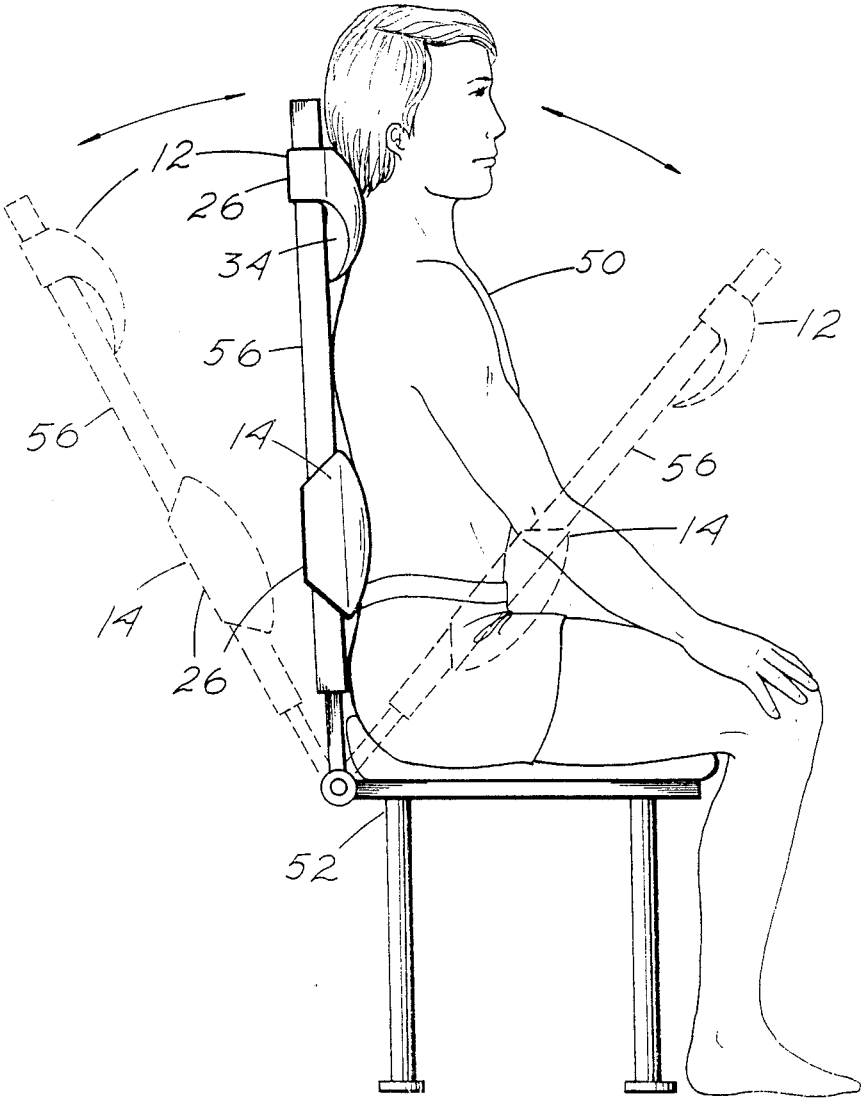
FIG. 3 shows use of the cervical spinal area pad and the lumbar spinal area pad affixed to a pivotal seat-type back exerciser illustrating versatility of the device according to the present invention.

Although the assemblage of invention members 10 is primarily directed towards horizontal usage as illustrated in FIG. 1, invention members 10 are applicable to a variety of uses such as use on the hinged type exercising chair 52 shown in FIG. 3. This versatility is provided through position adjustment of wraparound attachment use for affixing cervical spine area pad 12 and lumbar spine area pad 14 to a board-like surface such as chair back 56 of hinged type exercising chair 52. Padded mat 16 can easily be altered for use on a variety of chair backs 56 and weight lifter's bench boards 18.

As material choices are not critical to operational factors, all invention members 10 with attachments are considered adequately described in this specification to provide those skilled in the art with necessary information for fabricating invention members 10. The material of choice is a pliable plastic covering with seal formed edges having interior padding of foam plastic sufficiently firm to adequately support weight lifter 50 reclined as illustrated in FIG. 1.

Even though the invention members 10 have been described in detail, it is considered obvious that those skilled in the art could conceivably modify my invention and obtain similar results, therefore, I reserve the right to modify the invention in any manner consistent with the intended scope of the appended claims and modifications made by others which fall within the claim scope, I will consider as my invention.

What is claimed is:

1. An orthopedic back support attachment for a weight lifting bench comprising:

a substantially rectangular, longitudinally elongated padded mat, said padded mat having a use surface side and an oppositely disposed attachment surface side, and said padded mat having a groove providing a narrow channel centrally longitudinally aligned in said use surface side;

a pair of belts for removably attaching said padded mat to a support structure, each said belt having one end attached to the longer sides of said padded mat, the free ends of said pair of belts having fasteners being adjustably attachable to each other for releasably attaching said padded mat to the support structure; and, means on said padded mat for removably affixing attachments to said padded mat.

2. The orthopedic back support attachment of claim 1 wherein said means on said padded mat for removably affixing attachments to said padded mat includes a skirting along the outer edges of said padded mat, said skirting being arranged to fit partially around the support structure, and an elongated strip of a hook or loop fastener along said skirting for selective engagement with the hook or loop fastener of an attachment.

3. The orthopedic back support attachment of claim 1 wherein the free ends of the belt include buckle fasteners.

4. The orthopedic back support attachment of claim 1 wherein the free ends of the belt include hook and loop fasteners.

5. The orthopedic back support attachment of claim 1 further including a weight lifting bench serving as the support structure.

* * * * *